US009878764B2

(12) United States Patent
Pereira

(10) Patent No.: US 9,878,764 B2
(45) Date of Patent: Jan. 30, 2018

(54) SYSTEM TO PREVENT WATER FROM ENTERING A SNORKEL BREATHER TUBE

(75) Inventor: Odil Talles Pereira, Sao Paulo (BR)

(73) Assignee: Maria Julia Oller Pereira, Sao Paulo, DEP (BR)

( * ) Notice: Subject to any disclaimer, the term of this patent is extended or adjusted under 35 U.S.C. 154(b) by 460 days.

(21) Appl. No.: 14/007,548

(22) PCT Filed: Mar. 25, 2011

(86) PCT No.: PCT/BR2011/000087
§ 371 (c)(1),
(2), (4) Date: Sep. 25, 2013

(87) PCT Pub. No.: WO2012/129620
PCT Pub. Date: Oct. 4, 2012

(65) Prior Publication Data

US 2014/0014097 A1 Jan. 16, 2014

(51) Int. Cl.
*B63C 11/20* (2006.01)

(52) U.S. Cl.
CPC ..... *B63C 11/205* (2013.01)

(58) Field of Classification Search
CPC ..... B63C 11/205; B63C 11/16; B63C 11/207; B63C 2011/165
See application file for complete search history.

(56) References Cited

U.S. PATENT DOCUMENTS 5,404,872 A * 4/1995 Choi ..... B63C 11/205 128/201.11
5,865,169 A 2/1999 Lan et al.
6,202,644 B1 * 3/2001 Takeuchi ..... B63C 11/205 128/201.11
6,622,722 B2 * 9/2003 Chen-Lieh ..... B63C 11/205 128/200.29
2002/0170558 A1 11/2002 Vinokur et al.
2004/0211413 A1 10/2004 Monnich
2005/0087192 A1 * 4/2005 Li ..... B63C 11/205 128/207.11

FOREIGN PATENT DOCUMENTS

FR 2864939 A1 7/2005

* cited by examiner

*Primary Examiner* — Peter S Vasat
(74) *Attorney, Agent, or Firm* — Albert Bordas, P.A.

(57) ABSTRACT

A system to prevent water from entering a snorkel breather tube includes a tube, wherein the tube is attached to a snorkel body and a pressure device, wherein the pressure device is attached to the tube at a tube tip. The pressure device comprises an air passage channel extending through an internal portion of the pressure device and an output hole, the output hole enabling entry of air into the air passage channel while preventing water from entering when the equipment of the system is submerged.

2 Claims, 3 Drawing Sheets

SYSTEM TO PREVENT WATER FROM ENTERING A SNORKEL BREATHER TUBE

CROSS REFERENCE TO RELATED APPLICATIONS

This application is a National Stage Application of International Application No. PCT/BR2011/00087, filed on 25 Mar. 2011, the entire contents of which are hereby incorporated by reference.

FIELD OF DISCLOSURE

The present application relates to a system for preventing water from entering a tube and, in particular, to a system for preventing water from entering a snorkel breather tube, for instance, while the snorkel is being used in water.

BACKGROUND

A snorkel breather tube is a device that can be used by a swimmer in a wide variety of aquatic environments. Such a snorkel breather tube typically allows a swimmer to breathe while underwater by giving the swimmer access to atmospheric air a tube. During the course of swimming, a swimmer will typically move between various depths, which can cause the swimmer's snorkel breather tube to become completely submerged at times. In view of the fact that the snorkel breather tube acts to provide access to air to the swimmer, there is a clear need for a system to keep water from entering the snorkel breather tube and thereby prevent a swimmer from aspirating water.

SUMMARY

Exemplary embodiments of the invention are directed to systems to prevent water from entering a snorkel breather tube comprising a tube, wherein the tube is attached to a snorkel body and a pressure device, wherein the pressure device is attached to the tube at a tube tip, the pressure device comprising an air passage channel extending through an internal portion of the pressure device, and an output hole, the output hole enabling entry of air into the air passage channel.

BRIEF DESCRIPTION OF THE DRAWINGS

The accompanying drawings are presented to aid in the description of embodiments of the invention and are provided solely for illustration of the embodiments and not limitation thereof.

DETAILED DESCRIPTION

The system of the present application relates to a snorkel system, which allows the equipment of the system to be submerged, while preventing water from entering the snorkel breather tube. The tube tip of the present system is designed so that the pressure difference between the pressure in the breather tube and the pressure outside the breather tube operates to prevent water from entering the snorkel breather tube The system of the present invention allows for the enhanced use of existing snorkel equipment with higher efficacy and quality in the functions employed by the same. Thus, the equipment of the present system allows for safer and easier diving by preventing water entry into the snorkel breather tube, while diving. Further, the system of the present invention allows for protection against splashes during even when the equipment is not fully submerged.

Figure 1:
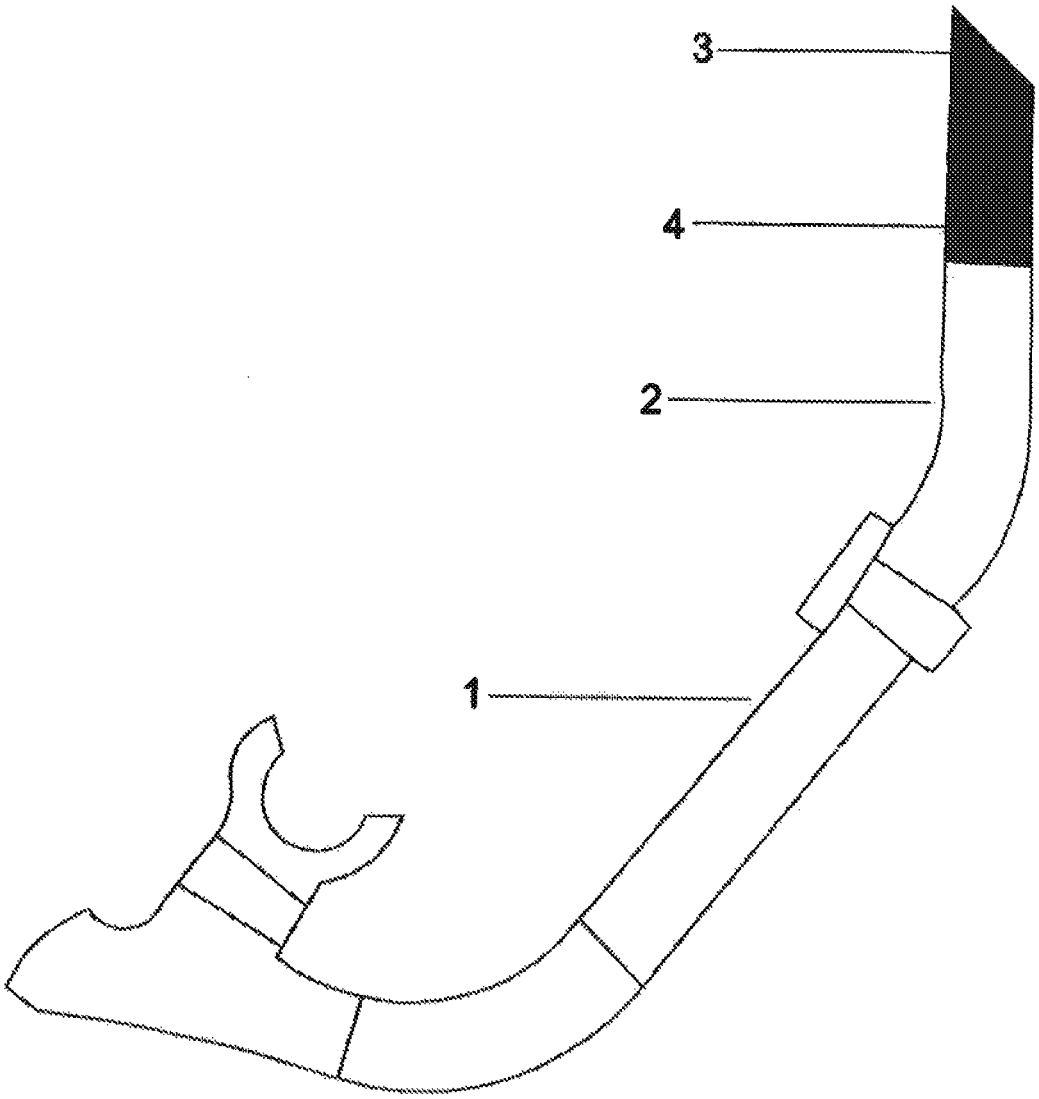
FIG. 1 is side view of a system to prevent water froth entering a snorkel breather tube consistent with the present invention.

With reference to FIG. 1, the system of the present invention includes a pressure device 3 that can be attached to a tube tip 4 of a tube 2, the end of the tube 2 that is opposite from the tube tip 4 can be attached to a snorkel body 1 of a snorkel breather tube.

Figure 2:
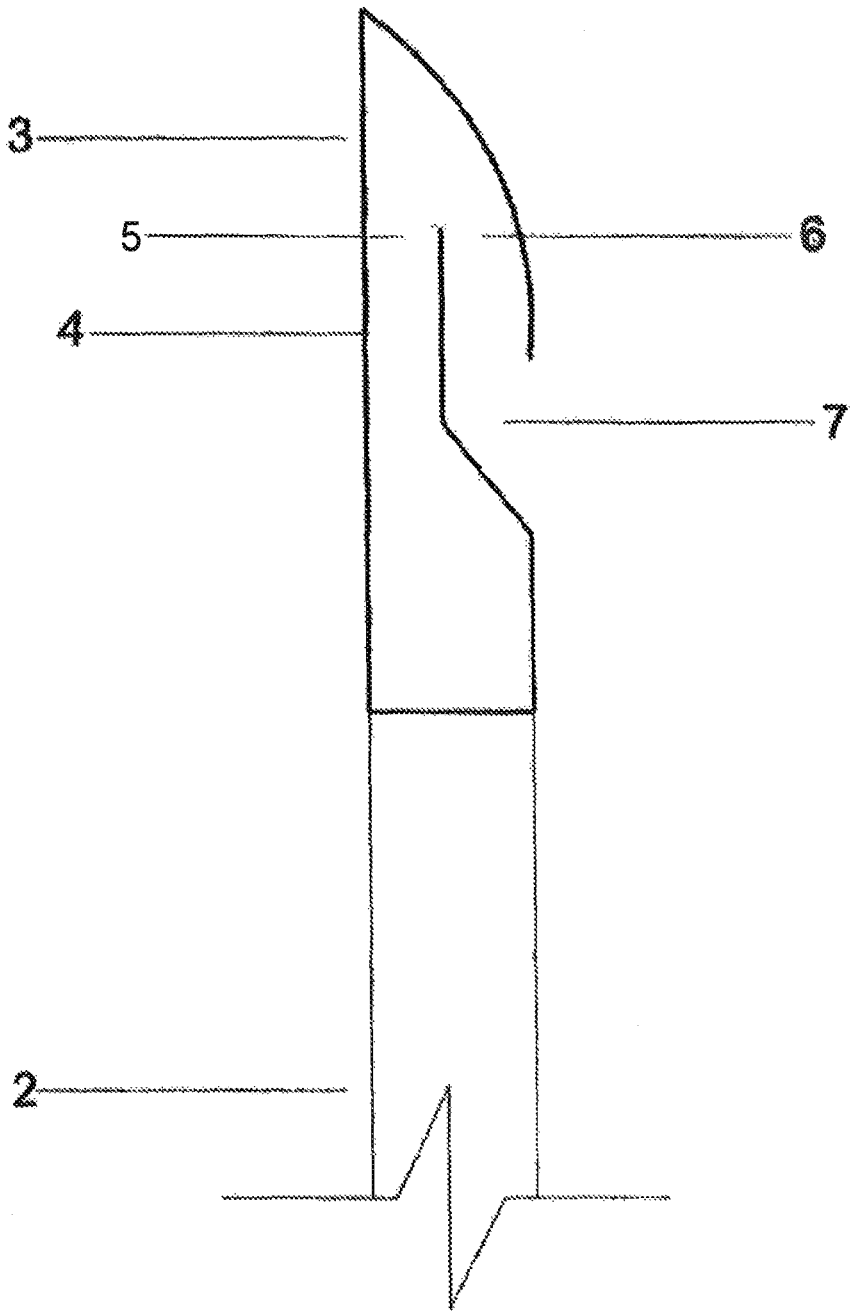
FIG. 2 is a cross-sectional view of a system to prevent water from entering a snorkel breather tube consistent with the present invention.
Figure 3:
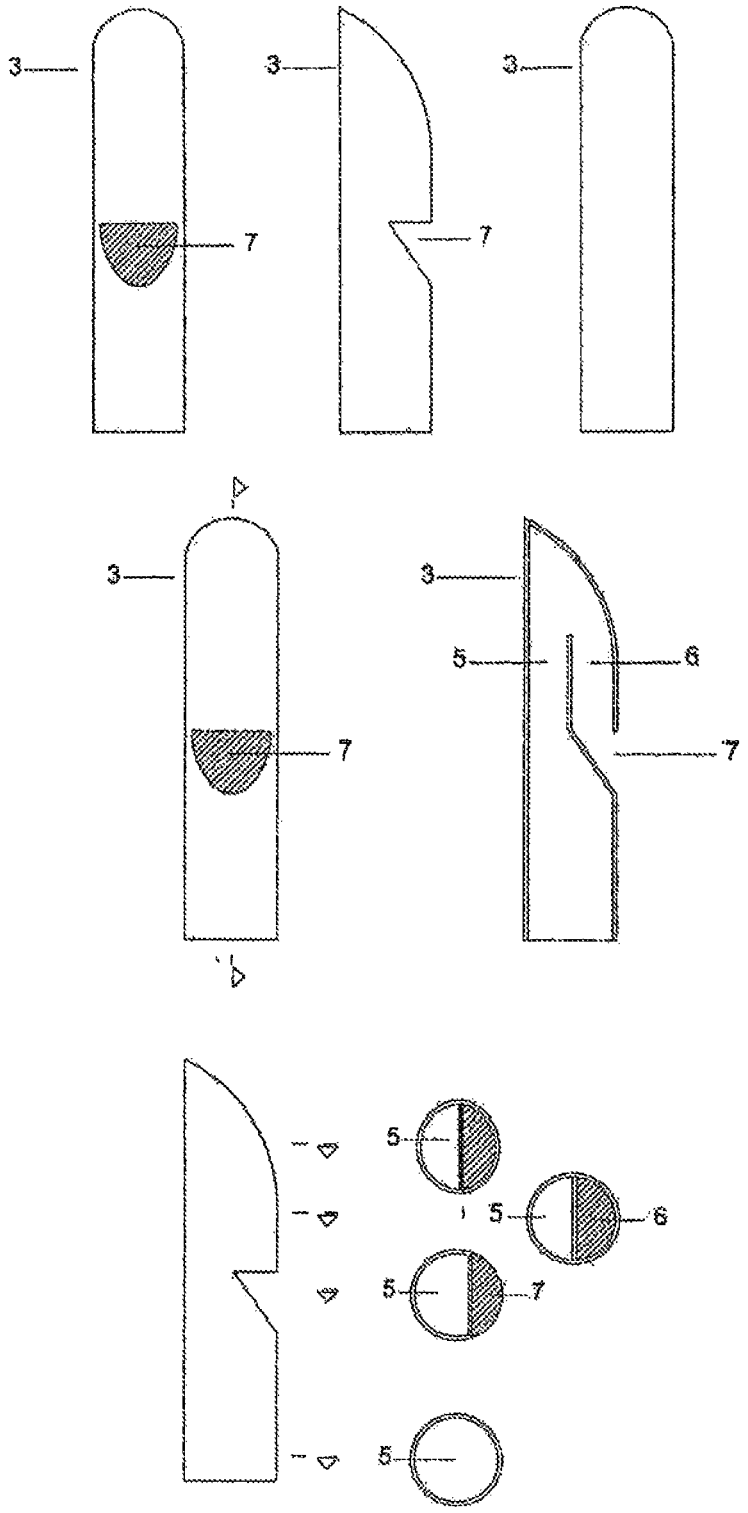
FIG. 3 illustrates additional views of a system to prevent water from entering a snorkel breather tube consistent with the present invention.

FIG. 2 illustrates a cross-sectional view of an embodiment of the system of the present invention, and FIG. 3 illustrates additional views of an embodiment of the system of the present invention. From these figures, the structure of the pressure device 3 can be seen. In particular, the pressure device 3 includes an air passage channel 5 in an internal portion 6 of the pressure device 3. The pressure device 3 further includes an output hole 7. Through the output hole 7 the air passage channel 5 communicates with an outside environment. Thus, when the system of the present invention is utilized during swimming, the outside hole 7 allows entry of air into the air passage channel 5 and then further into the tube 2 and the snorkel body 1, thereby allowing a user to breathe air while underwater.

In view of the novel structure of the present invention, the pressure device 3 at the end of the tube 2 maintains an internal pressure in the system that is sufficient to prevent water from entering through the outside hole 7. As a result, when in use, the equipment of the system can be completely submerged without having water enter the system. Thus, a user of the system swim without the need to keep a portion of the system above water at all times. Furthermore, the structure of the system helps prevent water from being splashed into the system, when the system is not completely submerged.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

The invention claimed is:

1. A system to prevent water from entering a snorkel breather tube, comprising:

A) a snorkel body comprising a mouth piece and an end;

B) a tube that extends from said end, said tube comprising a tube tip; and

C) a pressure device secured onto said tube tip, said pressure device comprising an outer wall, and an internal portion that defines a single dividing wall, a profile of said pressure device is cylindrical at least from a top of said single dividing wall to a bottom of said pressure device, said outer wall of a lower portion of said pressure device converges inward to meet said single dividing wall, and said single dividing wall extends across a central axis of said pressure device and extends past an output hole a substantial distance such that there is a hemi-circular flow path on either side of said single dividing wall, said output hole communicates with an outside environment and allows entry of air into said hemi-circular flow path to create and maintain an internal pressure that is sufficient to prevent water from entering through said output hole, wherein said hemi-circular flow path and said single dividing wall define a closed air cavity section to define an air pocket.

2. The system to prevent water from entering a snorkel breather tube set forth in claim 1, further characterized in that said hemi-circular flow path and said single dividing wall prevent splashed water from entering therein.

* * * * *